US008247929B2

(12) United States Patent
Pasquier

(10) Patent No.: US 8,247,929 B2
(45) Date of Patent: Aug. 21, 2012

(54) ELECTRICAL BYPASS DEVICE

(75) Inventor: Eric Pasquier, Saint-Benoit (FR)

(73) Assignee: Saft, Bagnolet (FR)

( * ) Notice: Subject to any disclaimer, the term of this patent is extended or adjusted under 35 U.S.C. 154(b) by 174 days.

(21) Appl. No.: 12/617,453

(22) Filed: Nov. 12, 2009

(65) Prior Publication Data

US 2010/0123358 A1 May 20, 2010

(30) Foreign Application Priority Data

Nov. 14, 2008 (FR) ..... 08 06 356

(51) Int. Cl.
*H01H 47/00* (2006.01)

(52) U.S. Cl. ..... 307/139

(58) Field of Classification Search ..... 307/139
See application file for complete search history.

(56) References Cited

U.S. PATENT DOCUMENTS 6,249,063 B1 * 6/2001 Rudoy et al. ..... 307/125

FOREIGN PATENT DOCUMENTS

FR 2 776 434 A1 9/1999
FR 2 902 232 A1 12/2007

OTHER PUBLICATIONS

French Search Report dated Jul. 9, 2009.

* cited by examiner

*Primary Examiner* — Robert L. Deberadinis
(74) *Attorney, Agent, or Firm* — Sughrue Mion, PLLC

(57) ABSTRACT

An electrical bypass device for a battery is provided for isolating and bypassing a defective battery module made up of secondary cells to allow the battery to continue operating under slightly degraded conditions. The bypass device comprises a first actuator and a second actuator which trigger when a module becomes defective. The actuators each comprise a first, second and third terminal. The first and second terminals are electrically connected to the output terminals of the secondary cells, and the third terminal can be switched between the first and the second terminal. Switching over of the third terminal of an actuator occurs when the actuator is triggered. Triggering (intentional or inadvertent) of one of the actuators leads automatically to triggering of the other actuator if the latter has not triggered.

20 Claims, 7 Drawing Sheets

ELECTRICAL BYPASS DEVICE

BACKGROUND OF THE INVENTION

The present invention relates to an electrical bypass device for bypassing and isolating a defective module of a battery.

Typically, a battery comprises a plurality of series-connected modules, each module comprising a plurality of series and/or parallel-connected electrochemical secondary cells. A battery is generally designed to operate under so-called nominal conditions, in other words inside of given power, voltage and current ranges. When one of the modules of the battery becomes defective as a result, for example, of ageing of certain secondary cells or through use outside of nominal conditions, internal resistance increases. When a defective module is in series with other modules that are operational, the high internal resistance of the defective module leads to the whole battery becoming non-operational, even if the number of non-defective modules is sufficient to keep the battery working in a slightly degraded operating mode. For very costly high power batteries for which replacement is difficult, isolating the defective module is a necessity. The use of actuators is known for isolating and bypassing a defective module to allow the battery to continue operating. As a defective module can in general not be repaired, such actuators are generally one-way single-use actuators.

FIGS. 1*a* and 1*b* are schematic diagrams of a frangible actuator as disclosed in French patent FR-A-2,776,434 (equivalent to U.S. Pat. No. 6,249,063 B1) at respectively the non-actuated and actuated position. The diagrams of FIGS. 1*a* and 1*b* are intentionally simplified to facilitate understanding of the principle of switching of the switches. Actuator 10 comprises a first, second and third power terminal respectively bearing reference numerals 1, 2, 3. Actuator 10 also comprises a plunger 4 including a switching portion 14. Plunger 4 is movable between two extreme positions, a first position in which power terminals 2 and 3 are electrically connected by switching portion 14 which we shall refer to below as the "connection position", and a second position in which it the power terminals 1 and 3 which are electrically connected by switching portion 14, which we call below the "isolating position". Actuator 10 is shown in the connection position in FIG. 1*a* and in the isolating position on FIG. 1*b*. Actuator 10 also comprises a frangible retaining member 5 which retains plunger 4 in the connection position. Retaining member 5 is kept closed by a fusible wire which melts when the battery cell module fails.

Actuator 10 also comprises a spring 6 which is compressed in the connection position and which urges plunger 4 to the isolating position. When the fusible wire melts, retaining member 5 get separated and no longer restrains plunger 4, plunger 4 is then slid to the isolating position through the action of spring 6.

In the connection position, changeoverswitch 14 makes switch 2-3 between the second actuator terminal 2 and the third actuator terminal 3. In the isolating position, changeover switch 14 makes switch 1-3 between first actuator terminal 1 and third actuator terminal 3.

When the actuator is connected to a module, the connection position corresponds to connection of the module in series with other modules, and the isolating position corresponds to an isolation of one terminal of a module, and to the module being bypassed. The actuator is connected to a module by electrically connecting first actuator terminal 1 and second actuator terminal 2 to the terminals of the secondary cells and connecting third actuator terminal 3 to a terminal of the following or preceding module.

FIG. 2*a* and FIG. 2*b* are circuit diagrams showing a module 7 connected to an actuator as described above. The first actuator terminal 1 is connected to a first terminal (positive terminal in diagram 2*a*, negative terminal in diagram 2*b*) of module 7 but also to an opposite polarity terminal (a negative terminal in diagram 2*a*, positive in diagram 2*b*) of a following (diagram 2*a*) or preceding (diagram 2*b*) module, connected in series with module 7. The second terminal 2 is connected to the other terminal (the negative terminal in diagram 2*a*, the positive terminal in diagram 2*b*) of module 7. The third terminal 3 is connected to a terminal of opposite polarity to that of the terminal connected to second terminal 2 of a preceding or following module. The preceding or following module connected to third terminal 3 is series connected to module 7 by the said switch 2-3. If module 7 is a first or last module of the battery, third actuator terminal 3 or first actuator terminal 1 is connected to one of the battery terminals.

The polarity of the terminals of module 7 connected to the first and second actuator terminal can also be reversed. FIG. 2*a* is an electrical circuit diagram in which the switch 2-3 is in series between the negative terminal of module 7 and the positive terminal of the preceding module 8 whereas in FIG. 2*b* an electrical circuit diagram is shown in which the switch 2-3 is in series between the positive terminal of module 7 and the negative terminal of the next module 9.

Thus, in electrical circuit diagram 2*a*, when the plunger is in the connection position, the normally closed switch 2-3 is in series between module 7 and a module 8 that precedes it. Similarly, the normally open switch 1-3 is in parallel with the series connection of module 7 and normally closed switch 2-3.

This means that when plunger 4 is in the connection position, module 7 is in series between the preceding module 8 and the module 9 that follows it via the switch 2-3 of the actuator. When module 7 fails, retaining member 5 separates and plunger 4 moves from the connection position to the isolating position under the influence of spring 6. In this way, the switch 2-3 gets broken off and isolates the terminal (the negative terminal in diagram 2*a*, the positive one in diagram 2*b*) of module 7 connected to second actuator terminal 2. The change of position of plunger 4 and switch 14 also closes the switch 1-3. Module 7 is now isolated and the modules that precede and follow it are connected in series by the switch 1-3 of the actuator.

The actuator as described above thus makes it possible to isolate and bypass a module that has failed in a battery, setting up an electrical circuit which bypasses and isolates this module.

There is an increasing need for batteries that supply higher power, for example for applications in the satellite field. To provide batteries supplying heavy currents, the number of secondary cells in parallel in each module is increased.

As illustrated in FIGS. 2*a* and 2*b*, each positive and negative terminal of the secondary cells is connected either to the first actuator terminal 1 or to the second actuator terminal 2 by stranded cable. Now, as is known, the heavier the current passing through the strands of a cable, the greater the amount of heat generated. Standards, such as European stand ECSS (European Co-operation on Space Standardization) Q30 11 A concerning derating of electrical, electronic and electromechanical components used for applications in the satellite domain, impose a minimum cross-section on stranded cable for a maximum current passing therethrough. Such standards are becoming even stricter, meaning that stranded wire cables need to have an even greater cross-section for a given current.

When the cross-section of stranded cables is increased, this has the effect of increasing battery weight, the latter being a determining factor for applications in the satellite domain. Further, when stranded cable cross-section is increased, this leads to increased stiffness thereby accentuating difficulties in cabling, and is detrimental to battery compactness.

One solution consists in using two cable runs in parallel, in other words connecting each secondary battery terminal using two separate stranded cables. In this case, the module would include two pairs of terminals each pair consisting of a positive and a negative terminal. Using two cable runs in this way makes it necessary to install two actuators for isolating and bypassing a module which has failed.

Now, if one of these actuators were to operate inadvertently or erroneously, without the other actuator is triggered, we would be faced with a short circuit at the module terminals. Indeed, in such a case, current could flow between one (for example positive) terminal connected to the normally closed switch of the actuator which has not triggered, and the other (for example negative) terminal connected to the closed switch of the triggered actuator, thereby setting up a short circuit between the positive and negative terminals of the module by passing via one terminal of the preceding module to the next one. Such short circuit could be a source of fire.

SUMMARY OF THE INVENTION

There is consequently a need for a device for bypassing and isolating an accumulator module which is suitable for doubled up cabling. To achieve this, the invention provides a device comprising two actuators, the triggering (intentional or inadvertent) of one of the actuators leading automatically to triggering of the second actuator.

In this way, the creation of a short circuit which could be a source of fire is prevented, even if just one actuator is inadvertently triggered.

The invention consequently provides a bypass device for a module made up of secondary cells, the module having at least two pairs of electrical output terminals, the device comprising:

- a first actuator including three power terminals, of which a first and a second terminal are electrically connected to a first pair of output terminals of the secondary cells and a third terminal is adapted to be switched over electrically between said first and second terminals,
- a second actuator including three power terminals, of which a first and a second terminal are electrically connected to a second pair of output terminals of the secondary cells and a third terminal is adapted to be switched over electrically between the first and second terminals, in which a switching over of the third terminal of the first actuator or, respectively, of the second actuator, triggers switching over of the third terminal of the second actuator or, respectively, of the first actuator.

Preferred embodiments can include one or several of the following characteristics:

- the third terminal and first terminal of each actuator form a normally open bypass switch, and in which the third terminal and the second terminal of each actuator form a normally closed isolation switch.
- each actuator further comprises means for controlling switching over of the third terminal.
- each of the means for controlling switching includes a fusible link.
- each actuator includes a control switch which switches when the third power terminal switches over and actuates switching over of the third terminal of the other actuator.
- each control switch is a normally open switch which closes when the third terminal is switched over.
- the switching control means of respectively the first and second actuator is mounted in parallel with the isolation switch of respectively the second and first actuator.

The invention further provides an actuator including:

- a body,
- a retaining device,
- a plunger retained in a first position in which it establishes contact between a first contact member and a second contact member and urged towards a second position in which it establishes contact between said second contact member and a third contact member,
- a fourth contact member and a fifth contact member forming a switch which switches over when the plunger moves from said first position to said second position.

In one embodiment, the actuator can comprise a contact plate mounted on the plunger and adapted to close the switch by establishing the contact between the fourth and fifth contact members when the plunger is in the second position.

In a further embodiment the actuator includes an insulating plate mounted on the plunger between the contact plate and the first, second and third contact members.

The invention further provides a battery comprising modules connected in series and at least one bypass device according to the invention.

In one embodiment, a first actuator is housed at one side of the battery and a second actuator is housed at the other side of the battery.

Further characteristics and advantages of the invention will become more clear from a reading of the detailed description which follows of some embodiments of the invention provided solely by way of example and with reference to the attached drawings.

DETAILED DESCRIPTION OF PREFERRED EMBODIMENTS

Figure 1A:
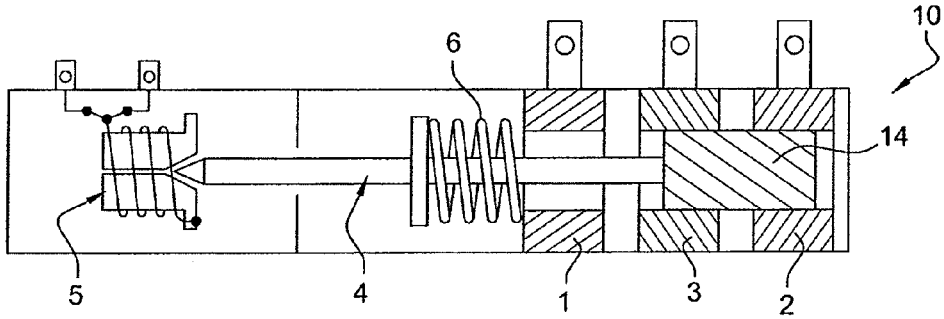
Fig. 1A PRIOR ART
FIG. 1*a*, which has already been described, shows a cross-section through a prior art actuator, in a first connection position.
Figure 1B:
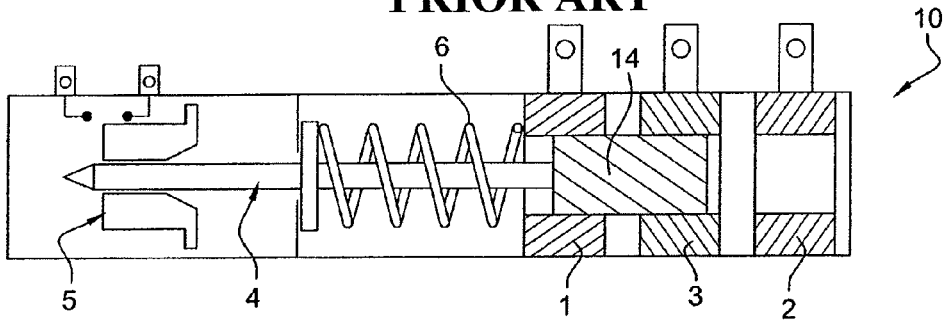
Fig. 1B PRIOR ART
FIG. 1*b*, already described, is a cross-section of a prior art actuator, in a second, isolating, position.

The bypass device for a secondary cell module according to the invention comprises a first actuator and a second actuator which trigger when the module becomes defective. The actuators each comprise a first, second and third power terminal. The first and second terminals are electrically connected to the output terminals of the secondary cells, and the third terminal can be switched between the first and the second terminal. Switching over of the third terminal of an actuator occurs when the actuator is triggered. Triggering of one actuator brings about triggering of the other actuator if the latter has not triggered. Thus, when the third terminal of one of the actuators gets switched over, switching over thereof immediately brings about switching over of the third terminal of the other actuator. As a result, if one actuator is triggered, the other actuator gets triggered with very little delay, less than 60 ms. During this extremely brief transitional period, the current supplied at the module terminals does get short-circuited by the first actuator which is triggered and the second actuator which has not yet triggered as explained above, but the duration of such short-circuiting is short enough (some 90 ms for the whole sequence), to prevent any risk of fire and deterioration of the battery.

The bypass device can advantageously be arranged with each actuator electrically connected to a module and doubling up the cabling connecting the secondary cells to the module terminals. Doubling up the cables makes it possible to increase battery power while using stranded cable of sufficiently small cross-section to retain ease of cabling, and battery compactness. Indeed, for a given current, and adhering to present day standards, one single stranded cable would need to have a greater active cross-section than the sum of the active cross-sections of two (doubled up) stranded cables, in parallel.

The bypass device also is advantageous in that the two actuators of small size are installed in the place of one single bulkier (larger) actuator for a given module. The advantage of such an installation is that of being able to keep the same actuator layout in a battery: in effect, as an actuator becomes more and more bulky as the current it handles increases, once a certain size is exceeded installing a large actuator in a battery would involve a modification to layout.

We shall describe various embodiments below with reference to the drawings. Those parts which are identical or similar in the drawings bear the same reference numerals.

Figure 3A:
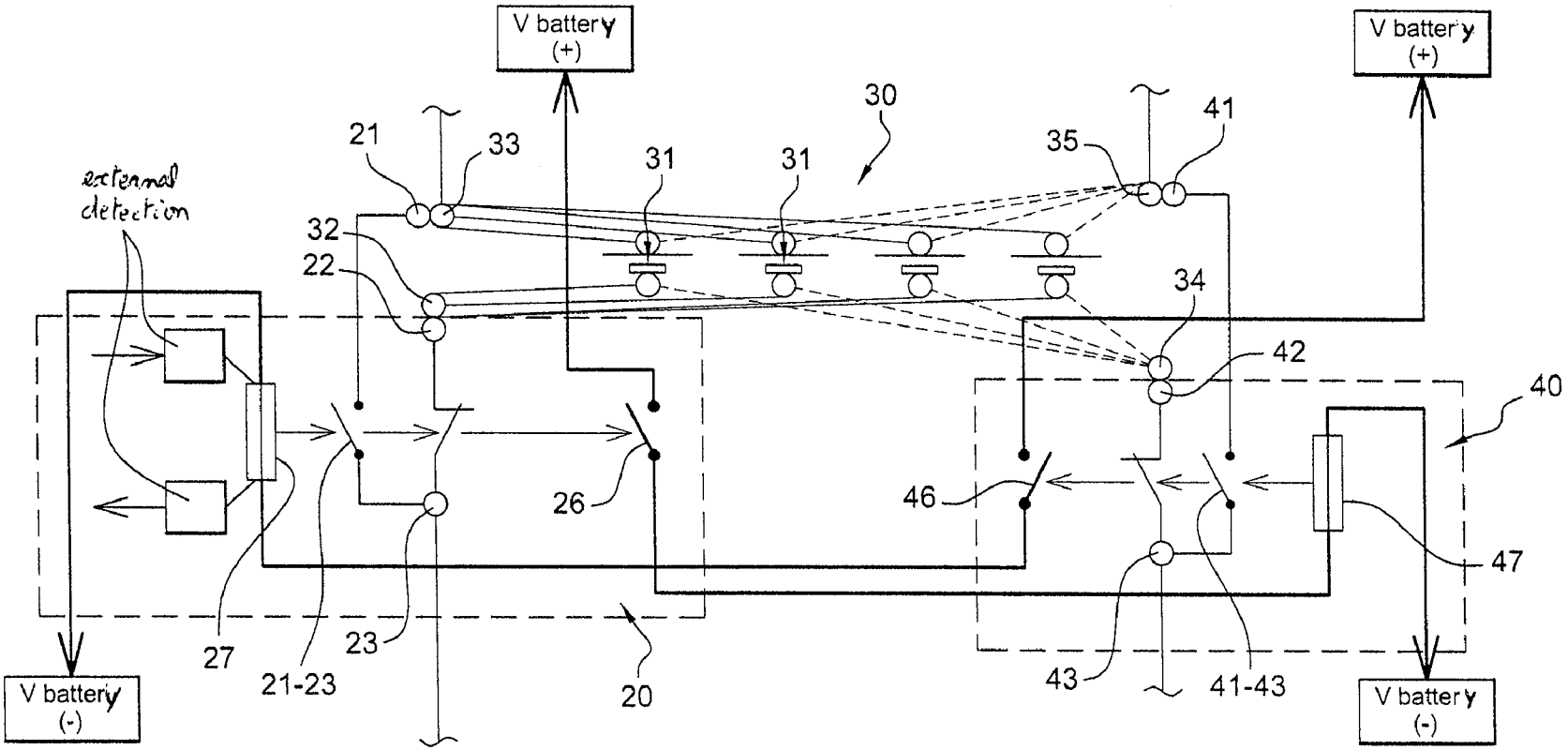
FIG. 3*a* is a circuit diagram of a bypass device, before triggering, connected to a module, according to a first embodiment of the invention.
Figure 3B:
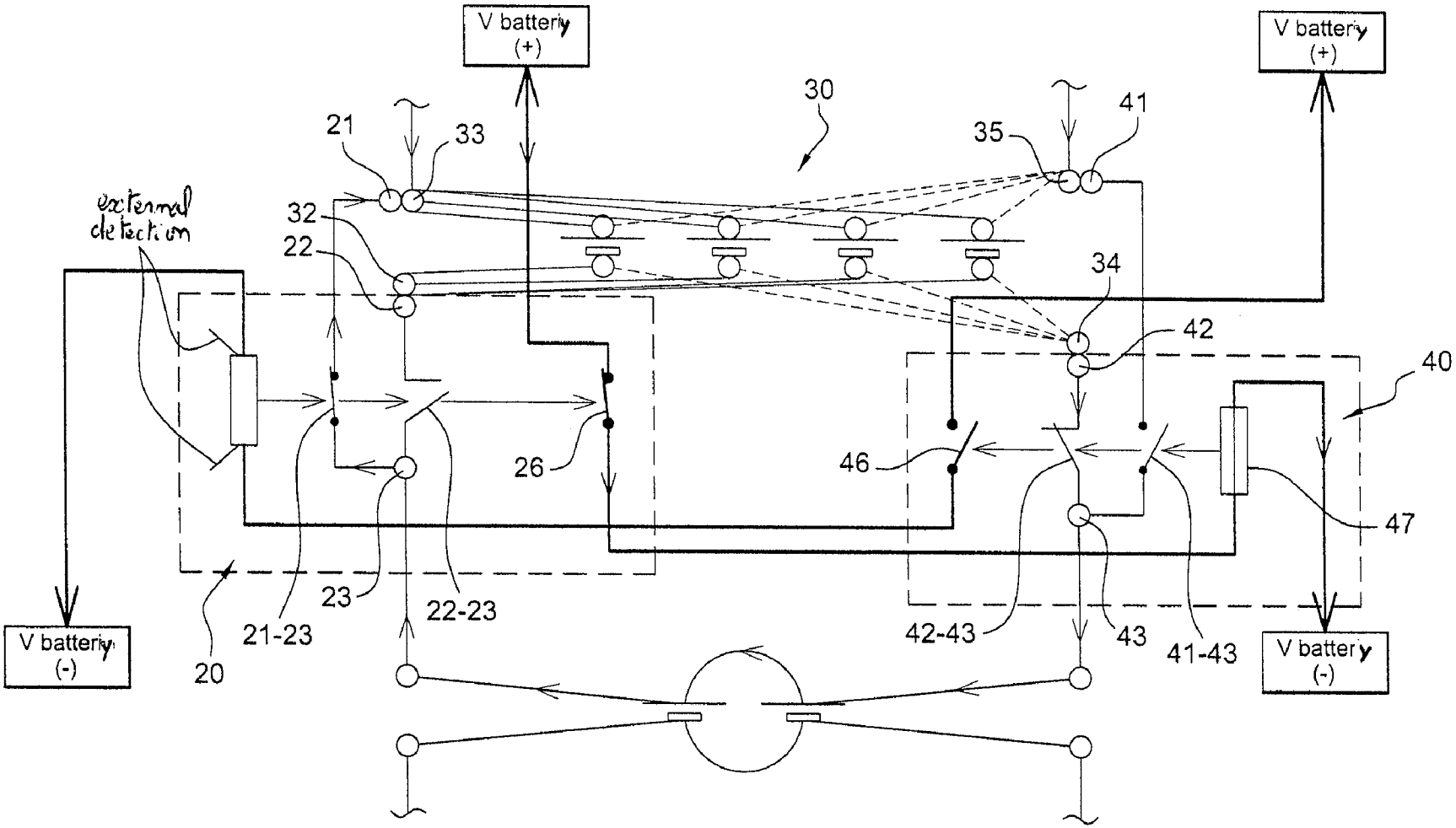
FIG. 3*b* is a circuit diagram of a bypass device according to a first embodiment of the invention, in which one of the actuators has been intentionally triggered.
Figure 3C:
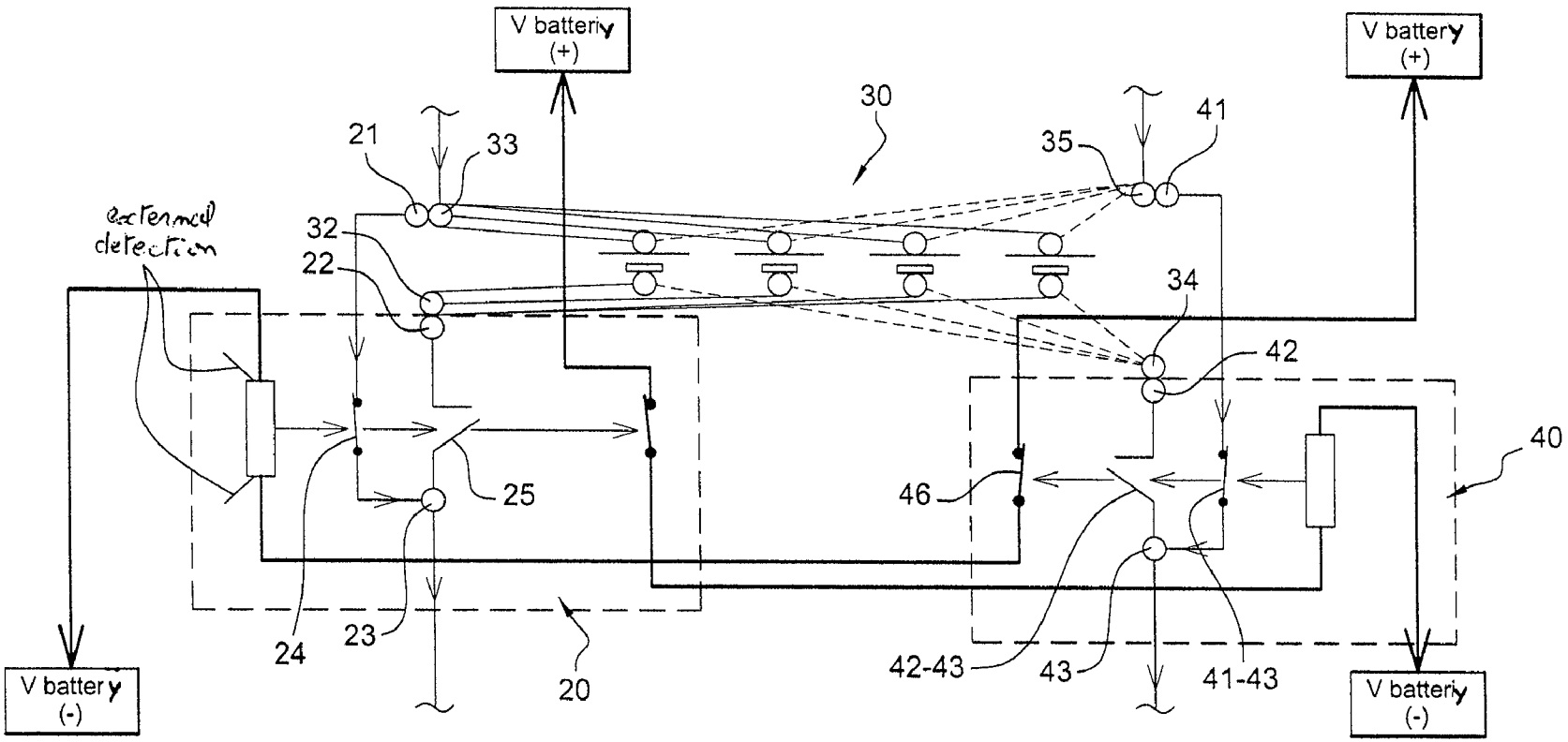
FIG. 3*c* is a circuit diagram of a bypass device which has been triggered, according to this first embodiment.

FIGS. 3*a*, 3*b*, 3*c* are circuit diagrams of a bypass device connected to a module 30 at various stages of operation according to a first embodiment.

Module 30 includes secondary cells 31 mounted in parallel and a first and second pair of output terminals which are connected to a bypass device. The first pair of terminals comprises a negative terminal 32 and a positive terminal 33 which are connected to a first actuator 20. The second pair of terminals comprises a negative terminal 34 and a positive terminal 35 which are connected to a second actuator 40. Each secondary cell 31 includes a positive and a negative terminal which are respectively connected, by stranded wire cables, to the two positive terminals and two negative terminals of the module. This achieves a doubling up of the cabling between the secondary cell terminals and the module terminals. Doubling up makes it possible to increase battery power while using stranded wire cable of sufficiently small cross-section to retain ease of cabling and good battery compactness. Under normal operating conditions, the positive terminals of the module are connected to the negative terminals of the following series-connected module (not shown) and the negative terminals are connected via actuators 20, 40 to the positive terminals of a preceding module connected in series as can be seen in FIG. 3*b*.

The first actuator 20 comprises a first power terminal 21, a second power terminal 22 and a third power terminal 23. The first and second power terminals 21 and 22 are respectively connected to the positive terminal 33 and negative terminal 32 of the first pair of secondary cells output terminals. The third power terminal 23 is connected to a positive terminal of the preceding module, as can be seen in FIG. 3*b*. First power terminal 21 and third power terminal 23 form terminals of a bypass switch 21-23 which is normally open when the actuator has not been triggered. The third power terminal 23 and second power terminal 22 form terminals of a normally closed isolation switch 22-23.

The second actuator 40 also has a first 41, second 42, and third 43 power terminal which are electrically connected to module 30 similarly to the first actuator 20, except that the first power terminal 41 and the second power terminal 42 are connected to the second pair of secondary cell terminals. The terminals of the second actuator similarly form the terminals of a normally open bypass switch 41-43 and the terminals of a normally closed isolation switch 42-43.

Thus, as long as the two actuators have not been triggered, the isolation switches 22-23 and 42-43 electrically connected the negative terminals of module 30 to the positive terminals of the preceding module thereby setting up a series connection between module 30 and the preceding module. The actuators are in a "connection position" as defined above.

Further, each actuator comprises switching control means 27, 47 respectively. The switching control means make it possible to control switching of the third terminal of the actuator to an "isolation position" as defined above. Here, switching is taken to mean changing the original state of a contact, for instance closing a contact which is normally open.

Each actuator also includes a control switch 26, 46 respectively which is normally open. Each control switch 26, 46 when it is closed, connects one of the power terminals of the battery (V battery (+) on FIGS. 3*a*-3*c*) to one terminal of the switching control means 27, 47 of the other actuator. The other terminal of the switching control means 27, 47 is connected to the other power terminal of the battery (V battery (−) on FIGS. 3*a*-3*c*). Each switching control means 27, 47 is thus firstly connected to a detection system which will be described below and, secondly connected to the battery power supply when the control switch 26, 46 of the other actuator is closed. A source of power other than the battery can be chosen to operate the switching control means 27, 47.

Each control switch 26, 46 is switched over when the actuator is triggered. Thus, when just one of the actuators is triggered, for instance inadvertently, its bypass and isolation switches switch over and its control switch gets closed. The effect of closing of the control switch is to connect the switching control means of the other actuator to a source of battery power which supplies electrical power above a predetermined value for triggering the switching control means. Thus, the control switch of the triggered actuator now simulates, at the switching control terminals of the actuator which has not triggered, a triggering control as if this module had become defective.

The control switch 26, 46 of an actuator makes it possible to cause the switches of the other actuator to switch over thereby simulating a module failure at the switching control terminals of the other actuator. The control switch makes it possible, when an actuator is triggered inadvertently, to switch over the third terminal (to switch the isolating and bypass switches) of the actuator which is not triggered.

The terminals of the switching control means 27 of actuator 20 are connected to a detection system (not illustrated).

This detection system is connected to the switching control means in parallel. This detection system monitors the state of each module of the battery and when a defective module is detected, it controls actuation of the actuators connected to the failed module. The detection system can control triggering of an actuator by connecting the terminals of the switching control means 27 of the actuator to a source of electrical power which supplies electrical power above a predetermined value. Thus, when a module 30 becomes defective, the first actuator 20 is triggered by the detection system. Triggering of this first actuator 20 brings about switching over of its bypass switch 21-23 and isolation switch 22-23. Switching over of isolation switch 22-23 and bypass switch with terminals 21-23 respectively brings about isolation of the negative terminals 32, 34 of the secondary cells of defective module 30, and connection of the positive terminals 33, 35 of said module 30 to the positive terminals of the preceding module.

In the embodiment illustrated, only the switching control means 27 of the first actuator 20 are connected to the detection system. Thus, when the first actuator is triggered by the detection system, the second actuator 40 is actuated by closing of the control switch 26 of the first actuator 20. The result is that both actuators are triggered and bring about isolation and bypassing of the failed module. The fact of controlling one single actuator makes it possible to reduce the number of cables in the battery. One could nevertheless envisage connecting the switching control means 27, 47 of each actuator to a detection system.

In this first embodiment, the switching control means for the actuators each comprise a fusible link which blows under the effect of electrical power greater than the predetermined value. Blowing of the fusible link makes it possible to operate closing of the control switch to provide for the second actuator to switch over. It is consequently important that the detection system applies a voltage to the fusible link terminals sufficient to cause it to blow.

When control switch 26, 46 closes and connects both terminals of the battery to the fusible link of switching control means 27, 47 a short circuit is set up. Blowing of the fusible link makes it possible to trigger the actuator and open the circuit between the two battery terminals, thereby putting an end to the short circuit between the battery terminals. The fusible link is selected whereby blowing of the fusible link under the effect of a short circuit is performed in an extremely brief period of time, of the order of 60 ms. The short circuit at the battery terminals is consequently interrupted before there is any possibility of starting a fire or deterioration.

FIG. 3*b* shows the electrical circuit diagram during this brief period of time, in particular when only first actuator 20 has triggered. It should be understood that FIG. 3*b* does not show a state of the device of the invention, but simply illustrates a transitional situation. When just one actuator has triggered, a short circuit is set up between negative terminal 34 of the second pair of terminals of module 30 and positive terminal 33 of the first pair of terminals of module 30. In effect, current can flow between these two terminals, passing via isolation switch 42-43 of the actuator which is not triggered, via the positive terminal of the previous module and the bypass switch 21-23 of the actuator which has triggered. When the isolation switch 42-43 of the second actuator opens, it interrupts this short circuit. The short circuit is in existence for an extremely short period of time (some 80 ms) preventing any starting of fire or deterioration.

FIG. 3*c* shows the circuit diagram after this brief period of time has elapsed, in other words when the fusible link of the second actuator has blown and when its switches have switched over. The two actuators of the device of the invention are in an actuated state (isolation position). Opening of isolation switch 42-43 of the second actuator isolates the negative terminal 34 of the second pair of cell terminals of the module. The effect of closing of bypass switch 41-43 is to bypass the defective module by directly connecting the negative terminal of the following module to the positive terminal of the preceding module thereby putting these two, following and preceding, modules in series.

Figure 4:
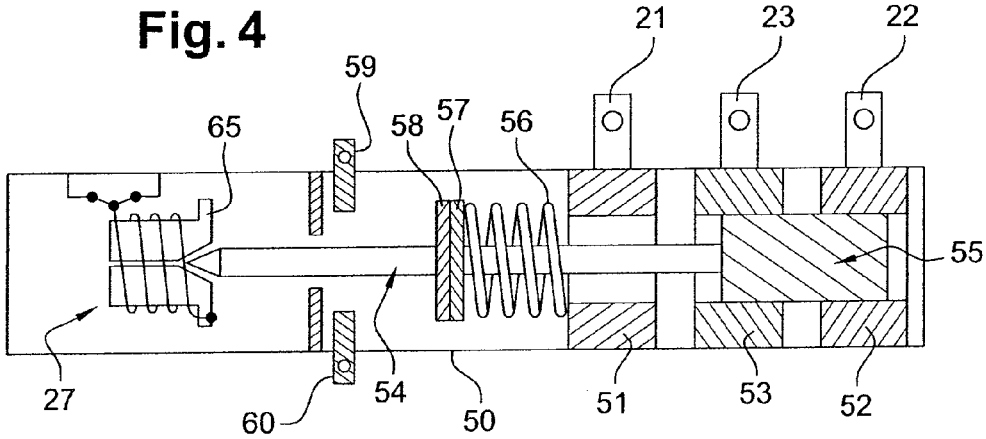
FIG. 4 is cross-section of an actuator according to this first embodiment, in the connection position.

The first actuator and second actuator can be identical. FIG. 4 shows a circuit diagram of an actuator according to an embodiment of the invention. The circuit diagram has been intentionally simplified to facilitate understanding of the switching of the switches. To aid comprehension, the references to the actuator of FIG. 4 are the same as those for the first actuator on FIGS. 3*a*, 3*b* and 3*c*.

The actuator comprises an electrically insulating body 50 from which three power terminals 21, 22, 23 project. Inside its body 50, the actuator has first; 51, second, 52, and third, 53, heavy duty contact members respectively connected to first power terminal 21, second power terminal 22 and third power terminal 23. Third power terminal 23 is located between the first and second power terminal 21 and 22. The actuator also includes a plunger 54. Plunger 54 is mobile between two extreme positions, a first position corresponding to the actuator in the non-triggered state (connection position) and a second position corresponding to the actuator in the triggered state (isolation position). Plunger 54 comprises an electrically conducting switching portion 55 which slides inside the contact members between the first and second position. The time it takes for switching portion 55 to slide (starting from the point where the fusible link has blown and the plunger becomes free to move) is around 20 ms. On FIG. 4, the actuator is shown in the connection position. In the connection position, switching portion 55 sets up electrical contact between a second and a third heavy duty contact members 52 and 53. In the isolation position, switching portion 55 establishes electrical contact between the third and a first contact member 53 and 51. While plunger 54 is sliding, switching portion 55 may, over a very brief period of time, of about 10 ms find itself in contact with the three contact members 51, 52 and 53. During this very brief interval, when the actuator is connected at the terminals of a module, a short circuit referred to as a terminal short-circuit is set up between the positive and negative terminals of the module. Terminal short-circuiting is interrupted when switching portion 55 has slid sufficiently to no longer be in contact with the second contact member 52.

The duration of short-circuiting between the positive and negative terminals of the module is equal to the sum of the duration of short-circuiting of the terminals (10 ms), the time it takes for the fusible link of the second actuator to blow (60 ms) and the time needed for the switching portion of the second actuator to slide (20 ms) making a total of around 90 ms.

The actuator also comprises the switching control means 27. The switching control means comprises the fusible link described above and a frangible retaining device 65 which retains piston 54 in a connection position. The actuator further comprises a spring 56 which is compressed in the connection position between contact member 51 and an electrically insulating plate 57 secured to piston 54 between contact member 51 and retaining device 65. Compressed spring 56 urges piston 54 towards the isolation position. Retaining device 65 comprises two cylinder halves pressed one against the other to form a cylindrical assembly. The cylinder halves are kept in contact by a retaining wire coil one end of which is fastened to the fusible link.

When the retaining device 65 is actuated, in other words when the fusible link has blown and the retaining wire is no longer retaining the two cylinder halves, piston 54 is urged by spring 56 to slide towards the isolation position.

The actuator further comprises an electrically conducting contact plate 58 secured to piston 54 between insulating plate 57 and retaining device 65. The actuator also includes a fourth contact member 59 and a fifth contact member 60 which form a control switch of the actuator. When piston 54 is in the isolation position, contact plate 58 establishes contact between the fourth contact member 59 and fifth contact member 60; the fourth and fifth contact members 59, 60 along with contact plate 58 consequently form the control switch 26. When piston 54 is in the connection position, control switch 26 is open and when piston 54 is in the isolation position, control switch 26 is closed via contact plate 58.

Insulating plate 57 protects the contact members 51, 52, 53 from coming into contact with contact plate 58. Contact plate 58 can be secured to insulating plate 57. This arrangement reduces the length of the actuator.

In this embodiment, redundancy can be used for wiring the terminals of the control switch to improve reliability of the bypass device.

Figure 5A:
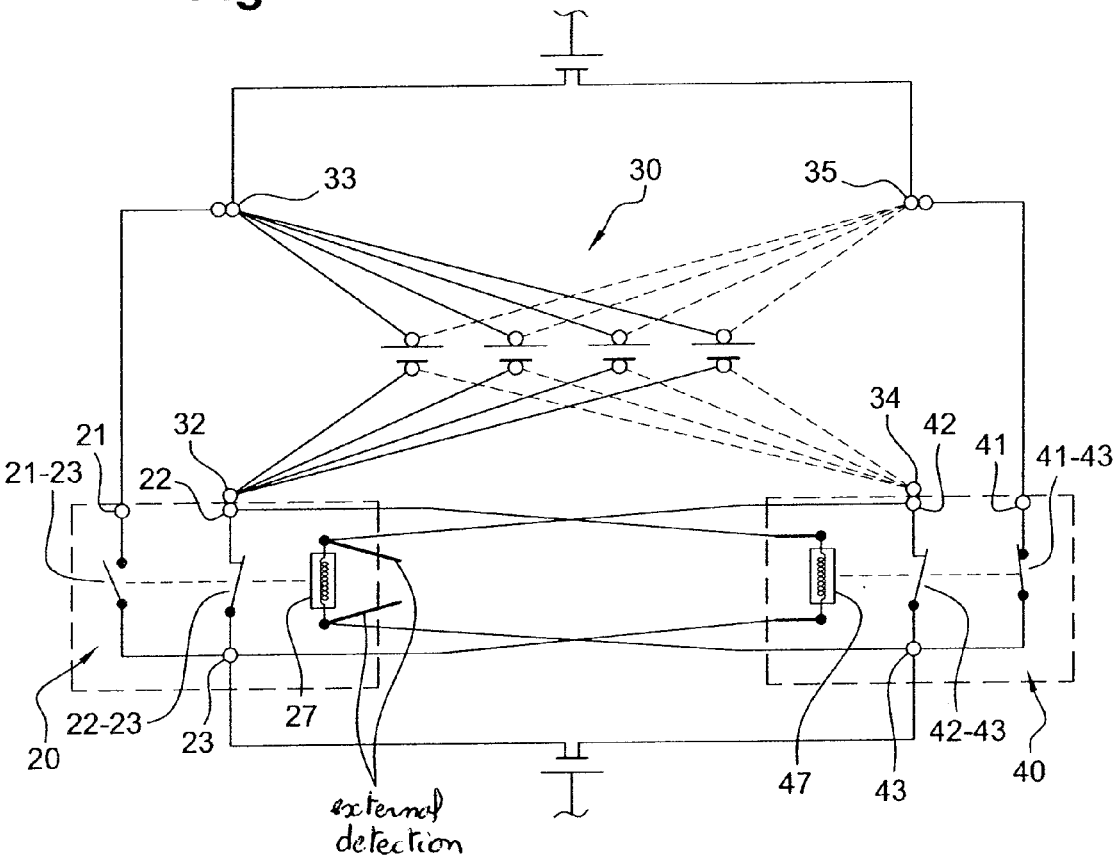
FIG. 5*a* is a circuit diagram of a bypass device before triggering, connected to a module, according to a second embodiment.
Figure 5B:
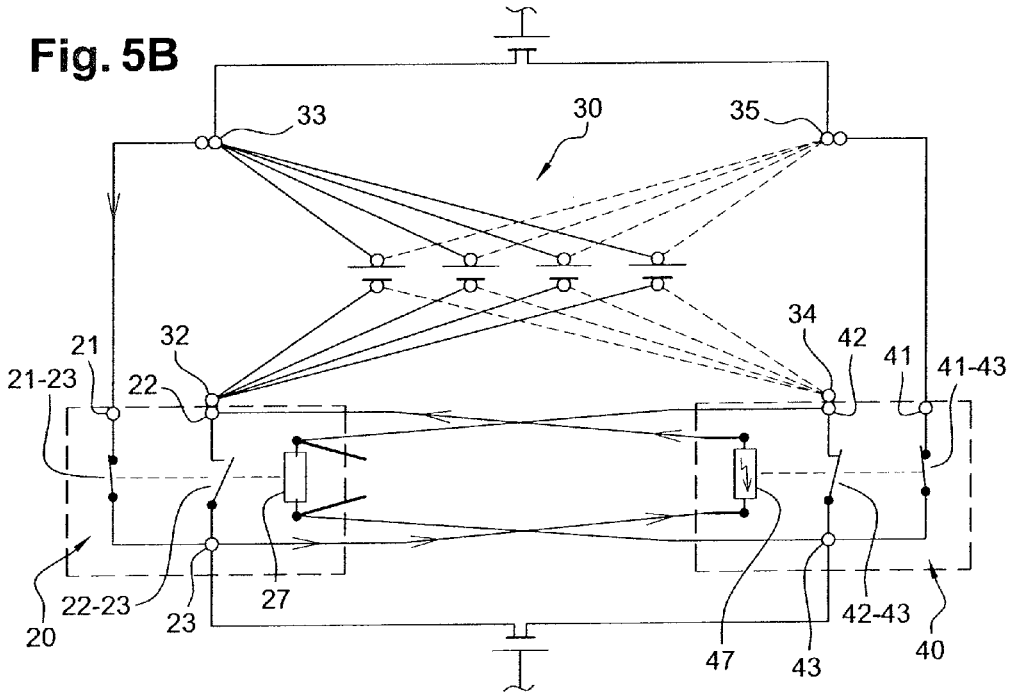
FIG. 5*b* is a circuit diagram of a bypass device according to the second embodiment, one of the actuators having been triggered intentionally.
Figure 5C:
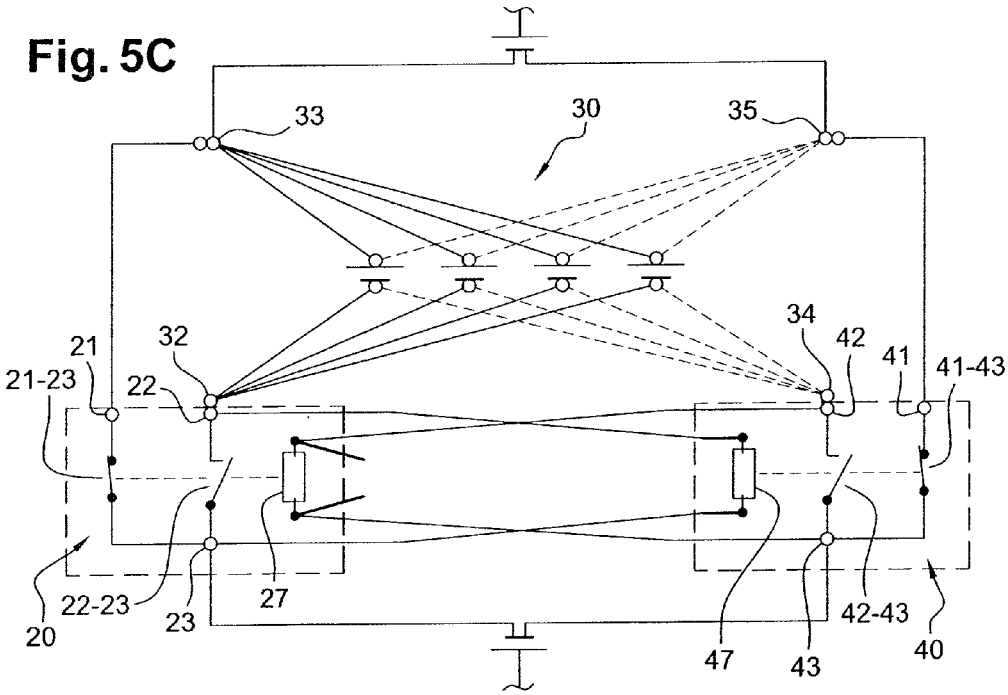
FIG. 5*c* is a circuit diagram of a triggered bypass device, according to this second embodiment.

FIGS. 5*a*, 5*b*, 5*c* are an electrical circuit diagram of a bypass device in various positions, according to a second embodiment. The description of the first embodiment also applies to this second embodiment for those parts which are common to both.

Figure 2A:
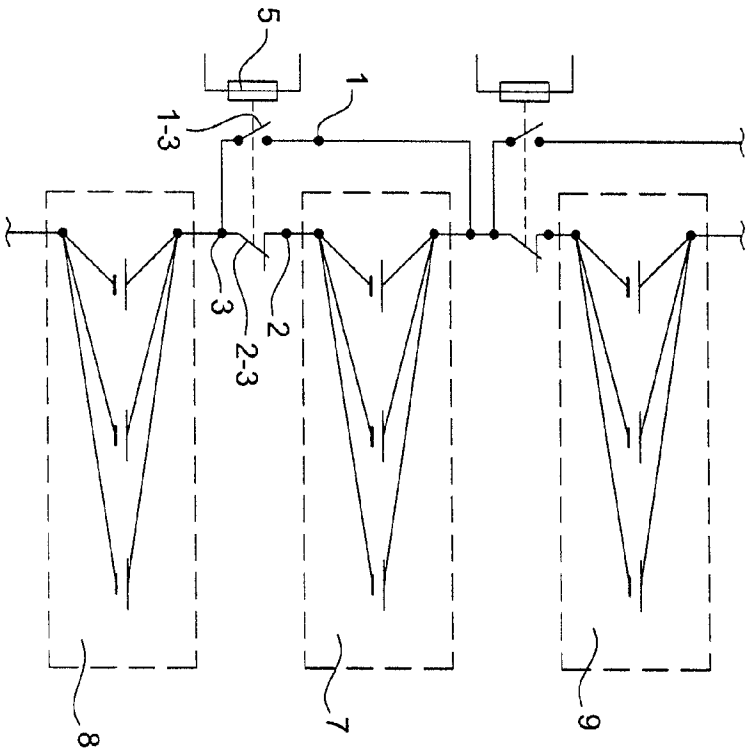
FIG. 2*a*, already described, is a circuit diagram of an actuator, not triggered, connected to a module.
Figure 2B:
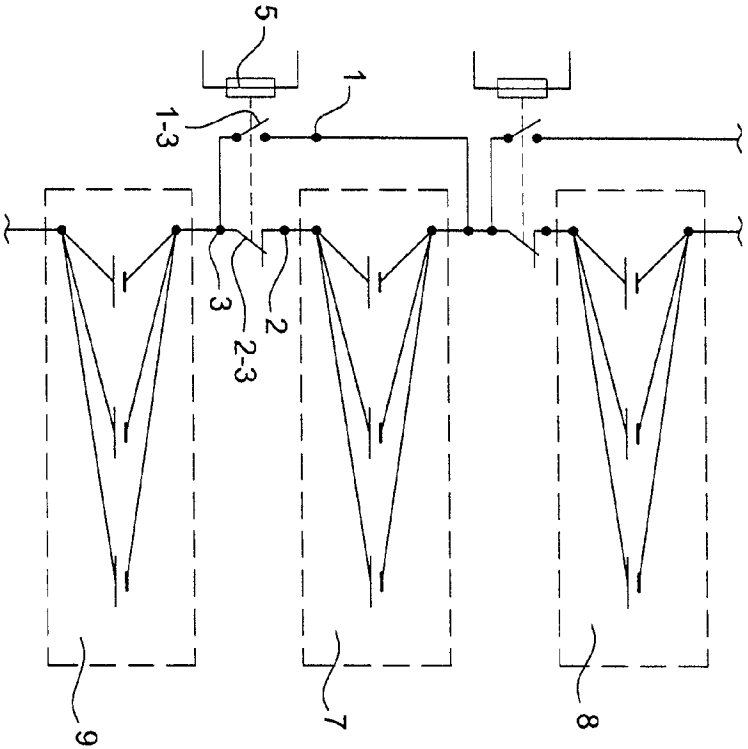
FIG. 2*b*, already described, is a circuit diagram of an actuator, not triggered, connected to a module.

According to this second embodiment, the control switches are no longer necessary and the terminals of switching control means 27, 47 are connected in a different way to the first embodiment. Here, the bypass device comprises two actuators designed, for instance, in the same way as the one disclosed in French patent FR-A-2,776,434 shown in FIG. 2. They can also be designed similarly to other prior art actuators.

Each actuator comprises a first terminal 21, 41, a second terminal 22, 42 and a third terminal 23, 43. The description given in association with the first embodiment regarding the first, second and third terminals applies also to this second embodiment notably as regards the wiring of the power terminals to the module terminals.

However, in this second embodiment, the switching control means 27, 47 of each actuator are connected in parallel with the terminals forming the isolation switch of the other actuator. Thus, in the example illustrated on FIGS. 5*a*-5*c*, switching control means 27 of the first actuator 20 are connected to the second terminal 42 and third terminal 43 of the second actuator 40, and the switching control means 47 of the second actuator are connected to the second terminal 22 and the third terminal 23 of the first actuator. Consequently, under normal operating conditions i.e. when neither of the actuators has triggered, most of the current passes via the closed isolation switches 22-23 and 42-43. Current passing through the isolation switch is in fact equal to the current output by the module multiplied by fusible link resistance, divided by the sum of the isolation switch and fusible link resistances, meaning that the more the fusible link resistance exceeds the resistance of the isolation switch, the more current will pass through the isolation switch (divider bridge principle).

As described with reference to the first embodiment, when the detection system detects that a module has failed, the isolation switch 22-23 and bypass switch 21-23 of the first actuator 20 switch over. As the switching control means 47 of the second actuator 40 mounted in parallel with the isolation switch 22-23 of the first actuator 20, a bypass circuit is set up which bypasses isolation switch 22-23. This circuit prevents isolation of negative terminal 32 of the module and sets up a short circuit between negative terminal 32 and the positive terminal 33 of the module. This short-circuit is illustrated on FIG. 5*b* by arrows. The short circuit produces more power at the terminals of switching control means 47 than the predetermined value, causing the fusible link to blow. Blowing of the fusible link brings about switching over of the contacts of the second actuator 40, interrupting the short circuit and isolating negative terminal 42 of the module.

Thus, as discussed in relation with the first embodiment, the duration of the short-circuit between the positive and negative terminals of the module is equal to the sum of the duration of short circuit of the terminals of the first actuator (10 ms), the time the fusible link of the second actuator takes to blow (60 ms) and the time the switching portion of the second actuator takes to slide (20 ms) making a total duration of short circuit of some 90 ms, or less if the fusible link were to start to blow while the terminals are short-circuited.

Similarly, if an actuator triggers inadvertently, the switching control means of the other actuator will bypass the isolation switch of the actuator which triggered, setting up a short circuit between the terminals connected to the actuator which triggered. The short circuit brings about blowing of the fusible link of the switching control means of the actuator which has not triggered. As a consequence, both switching control means are actuated, and both actuators have triggered.

In this second embodiment, the isolating switch preferably has a very low resistance, less than 300 μΩ and the resistance of the bypass circuit is at least 2500 times greater than the resistance of the isolation switch so that the current passing through the fusible link will be sufficiently small not to cause it to blow under normal operating conditions. One can obviously include a resistor in series with the switching control means between the isolation switch of one actuator and the switching control means of the other actuator. This resistor would make it possible to increase the resistance of the bypass circuit thereby reducing the risk of the switching control means being actuated inadvertently. Nevertheless, it is important not to choose a resistance value which is too high as this would reduce also the current passing through the fusible link of the switching control means of the non-triggered actuator.

Obviously, the invention is not limited to the examples and embodiments described and illustrated. In particular, in embodiments, the polarity of the module terminals connected to the actuators of the bypass device can be reversed. For instance, the first contact member of each actuator can be connected to a negative terminal of a module and the second contact member of each actuator can be connected to a positive terminal of a module.

Depending on the embodiment, the module connected to the bypass device can be connected to other modules each connected to a bypass device. The bypass devices connected to the modules of the battery can be identical or different.

Depending on the embodiment, the terminal of the preceding module or the terminal of the following module can be one of the terminals of the battery if module 30 is a first or the last series-connected module.

Depending on the embodiment, the bypass device can include more than two actuators. The number of actuators depends on the degree of redundancy of the wiring. For example, if we take the case of triple cabling of the secondary cells of a module, the bypass device would include three actuators.

Depending on the embodiment, the stranded wire cables can be laid along two opposing lateral sides of the battery and the first actuator is housed at one side of the battery and the second actuator is housed at the other side of the battery. Such positioning makes it possible to balance the heat created by the dual heating effect in the cables, in the battery.

Depending on the embodiment, the fusible link can be replaced by any other detection means. For example, the fusible link can be replaced by a bimetal with a non-return system to ensure the actuator operate irreversibly.

The invention claimed is:

1. A bypass device for a module made up of secondary cells, the module having at least two pairs of electrical output terminals, the device comprising:

a first actuator including three power terminals, of which a first and a second terminal are electrically connected to a first pair of output terminals of the secondary cells and a third terminal is adapted to be switched over electrically between said first and second terminals, a second actuator including three power terminals, of which a first and a second terminal are electrically connected to a second pair of output terminals of the secondary cells and a third terminal is adapted to be switched over electrically between the first and second terminals, in which a switching over of the third terminal of the first actuator or, respectively, of the second actuator, triggers switching over of the third terminal of the second actuator or, respectively, of the first actuator.

2. The bypass device according to claim 1, in which the third terminal and first terminal of each actuator form a normally open bypass switch, and in which the third terminal and the second terminal of each actuator form a normally closed isolation switch.

3. The bypass device according to claim 2 in which each actuator includes a control switch which switches when the third power terminal is switched over and actuates switching over of the third terminal of the other actuator.

4. The bypass device according to claim 1, in which each actuator further comprises means for controlling switching over of the third terminal.

5. The bypass device according to claim 4, in which each of the means for controlling switching includes a fusible link.

6. The bypass device according to claim 5, in which the third terminal and first terminal of each actuator form a normally open bypass switch, and in which the third terminal and the second terminal of each actuator form a normally closed isolation switch, and in which the switching control means of respectively the first and second actuator are mounted in parallel with the isolation switch of respectively the second and first actuator.

7. The bypass device according to claim 4 in which each actuator includes a control switch which switches when the third power terminal is switched over and actuates switching over of the third terminal of the other actuator.

8. The bypass device according to claim 4, in which the third terminal and first terminal of each actuator form a normally open bypass switch, and in which the third terminal and the second terminal of each actuator form a normally closed isolation switch, and in which the switching control means of respectively the first and second actuator are mounted in parallel with the isolation switch of respectively the second and first actuator.

9. The bypass device according to claim 1, in which each actuator includes a control switch which switches when the third power terminal is switched over and actuates switching over of the third terminal of the other actuator.

10. The bypass device according to claim 9, in which each control switch is a normally open switch which closes when the third terminal is switched over.

11. An actuator including:

a body, a retaining device, a plunger retained in a first position in which it establishes contact between a first contact member and a second contact member and urged towards a second position in which it establishes contact between said second contact member and a third contact member, a fourth contact member and a fifth contact member forming a switch which switches over when the plunger moves from said first position to said second position.

12. The actuator according to claim 11, comprising a contact plate mounted on the plunger and adapted to close the switch by establishing contact between the fourth and fifth contact members when the plunger is in the second position.

13. The actuator according to claim 12, including an insulating plate mounted on the plunger between the contact plate and the first, second and third contact members.

14. A battery comprising modules connected in series and at least one bypass device for a module made up of secondary cells, the module having at least two pairs of electrical output terminals, the bypass device comprising:

a first actuator including three power terminals, of which a first and a second terminal are electrically connected to a first pair of output terminals of the secondary cells and a third terminal is adapted to be switched over electrically between said first and second terminals, a second actuator including three power terminals, of which a first and a second terminal are electrically connected to a second pair of output terminals of the secondary cells and a third terminal is adapted to be switched over electrically between the first and second terminals, in which a switching over of the third terminal of the first actuator or, respectively, of the second actuator, triggers switching over of the third terminal of the second actuator or, respectively, of the first actuator.

15. The battery according to claim 14 in which a first actuator is housed at one side of the battery and a second actuator is housed at the other side of the battery.

16. The battery according to claim 14 in which the third terminal and first terminal of each actuator form a normally open bypass switch, and in which the third terminal and the second terminal of each actuator form a normally closed isolation switch.

17. The battery according to claim 14 in which each actuator further comprises means for controlling switching over of the third terminal.

18. The battery according to claim 14 in which each actuator includes a control switch which switches when the third power terminal is switched over and actuates switching over of the third terminal of the other actuator.

19. The battery according to claim 16 in which each actuator further comprises means for controlling switching over of the third terminal and in which the switching control means of respectively the first and second actuator are mounted in parallel with the isolation switch of respectively the second and first actuator.

20. The battery according to claim 18 in which each actuator includes:

a body, a retaining device, a plunger retained in a first position in which it establishes contact between a first contact member and a second contact member and urged towards a second position in which it establishes contact between said second contact member and a third contact member, a fourth contact member and a fifth contact member forming the control switch which switches over when the plunger moves from said first position to said second position.

* * * * *